US009279616B2

(12) United States Patent
Gibbel

(10) Patent No.: US 9,279,616 B2
(45) **Date of Patent: *Mar. 8, 2016**

(54) LIQUID COALESCENCE AND VACUUM CHAMBER DRYER SYSTEM AND METHOD

(71) Applicant: MEI, LLC, Albany, OR (US)

(72) Inventor: David S. Gibbel, Falls City, OR (US)

(73) Assignee: MEI, LLC, Albany, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/271,332

(22) Filed: May 6, 2014

(65) Prior Publication Data

US 2014/0310975 A1 Oct. 23, 2014

Related U.S. Application Data

(63) Continuation of application No. 13/022,483, filed on Feb. 7, 2011, now Pat. No. 8,756,826.

(60) Provisional application No. 61/418,318, filed on Nov. 30, 2010.

(51) Int. Cl.

| | |
|---|---|
| ***F26B 5/04*** | (2006.01) |
| ***F26B 5/12*** | (2006.01) |
| ***F26B 21/00*** | (2006.01) |
| ***F26B 21/12*** | (2006.01) |
| ***F26B 9/06*** | (2006.01) |

(52) U.S. Cl.

CPC . *F26B 5/12* (2013.01); *F26B 5/042* (2013.01); *F26B 9/066* (2013.01); *F26B 21/00* (2013.01); *F26B 21/12* (2013.01)

(58) Field of Classification Search

CPC ..... F26B 21/00; F26B 21/12; F26B 5/042; F26B 5/12; F26B 9/066

See application file for complete search history.

(56) References Cited

U.S. PATENT DOCUMENTS

| | | | |
|---|---|---|---|
| 4,506,453 | A | 3/1985 | Shirley, Jr. et al. |
| 5,048,201 | A | 9/1991 | Layton |
| 5,427,718 | A | 6/1995 | Phelps |
| 5,617,647 | A | 4/1997 | Okane et al. |
| 5,636,446 | A | 6/1997 | Mae et al. |

(Continued)

FOREIGN PATENT DOCUMENTS

| | | | |
|---|---|---|---|
| DE | 19910723 | A1 | 9/2000 |
| DE | 102006023198 | A1 | 11/2007 |
| EP | 0421902 | A1 | 4/1991 |

OTHER PUBLICATIONS

International Search Report and Written Opinion dated Jan. 27, 2012, issued in corresponding PCT Application No. PCT/US2011/049179, filed Aug. 25, 2011.

(Continued)

*Primary Examiner* — Jiping Lu

(74) *Attorney, Agent, or Firm* — Klarquist Sparkman, LLP

(57) ABSTRACT

A coalescing dryer passes air downwardly through items to be dried in a container. The air can be diverted to change direction following passage of the air through the items to be dried. The moving air causes liquid on the surface of items to be dried to coalesce and travel downwardly and from the items being dried. A vacuum dryer applies a vacuum to the container of items to be dried when placed in a vacuum chamber after pre-drying by the coalescing dryer so as to evaporate liquid in the items to be dried that has not been removed by the coalescing dryer.

10 Claims, 12 Drawing Sheets

(56) References Cited

U.S. PATENT DOCUMENTS

| | | | | |
|---|---|---|---|---|
| 5,732,478 | A | 3/1998 | Chapman et al. | |
| 5,899,001 | A | 5/1999 | Layton | |
| 6,170,171 | B1 | 1/2001 | Schmidbauer et al. | |
| 8,756,826 | B2 * | 6/2014 | Gibbel | 34/403 |
| 2012/0131814 | A1 | 5/2012 | Gibbel | |

OTHER PUBLICATIONS

English language abstract and machine translation of invention disclosure and claims for EP 0421902 A1.

English language abstract and machine translation of invention disclosure and claims for DE 19910723 A1.

English language abstract and machine translation of invention disclosure and claims for DE 102006023198 A1.

Cengel, Y.; Thermodynamics: An Engineering Approach, 4th Edition; pp. 672, 673, 830-833.

Office action dated Feb. 11, 2013, issued by the United States Patent and Trademark Office in corresponding U.S. Appl. No. 13/022,483, filed Feb. 7, 2011.

Office action dated Oct. 25, 2013, issued by the United States Patent and Trademark Office in corresponding U.S. Appl. No. 13/022,483, filed Feb. 7, 2011.

* cited by examiner

LIQUID COALESCENCE AND VACUUM CHAMBER DRYER SYSTEM AND METHOD

CROSS REFERENCE TO RELATED APPLICATION

This application is a continuation of U.S. patent application Ser. No. 13/022,483, entitled LIQUID COALESCENCE AND VACUUM CHAMBER DRYER SYSTEM AND METHOD, filed Feb. 7, 2011, and also claims the benefit of U.S. Provisional Patent Application No. 61/418,318, entitled LIQUID COALESCENCE AND VACUUM DRYER SYSTEM AND METHOD, filed Nov. 30, 2010. Both of which applications are incorporated by reference herein.

TECHNICAL FIELD

This disclosure relates to drying both newly produced and reclaimed materials, including monosilicon and polysilicon, used, for example, in wafer production, or semiconductor processing and/or solar cell production applications.

BACKGROUND

One prior approach for removal of DI water (deionized water) from silicon materials required very large, long, expensive hot air conveyor belt dryers that were fairly ineffective and that could only produce dried polysilicon material in a reasonable period of time if the material were heated to temperatures making the material difficult to handle by operators. The volume of recycled material in a wafer and/or solar cell processing line is so large that such hot air dryers must be extremely long to completely dry a basket of polysilicon material in a reasonable period of time, typically requiring a material residence time of approximately thirty minutes in order to achieve an output rate of one basket every six minutes. This rate of drying is necessary for practical operation. These long dryers take up a considerable amount of production floor space. In addition the process of drying with hot air accelerates native oxide growth during the dry cycle. The standards for minimum purity levels of the recycled polysilicon material continue to increase and the presence of native oxide can make it difficult to satisfy these increasing purity requirements.

Another known method to remove the moisture from these materials is to utilize a vacuum chamber to reduce atmospheric pressure and force the water to boil at room temperature. Although this method provides material that is cool to the touch, there have been issues with the material being frozen in the center and ineffective drying in that some product tends to remain wet. Also, it is extremely difficult to remove large quantities of water using only a vacuum chamber, as the process transitions from one of rapid, flash vaporization to slow sublimation once all the sensible heat above 0° C. is removed. Therefore this approach is less than satisfactory.

SUMMARY

Items to be dried, namely materials and objects that have surface moisture thereon are dried by a plural stage dryer, such a dryer comprising a coalescing dryer stage and a subsequent vacuum drying stage. Enough moisture is desirably removed from the items in the coalescing stage so that the items can be completely dried in the vacuum drying stage within a target drying time. The plural stage dryer can be included in a wet bath semiconductor processing line.

Examples of items to be dried can include, but are not limited to, reclaimed and raw (new) silicon material and silicon precursor materials, such as one or more of silicon particles, silicon gravel and silicon chunks. Small electronic components, such as capacitors that have been rinsed are another example of items that can be dried.

In accordance with an embodiment, a drying method comprises removing a container of items to be dried from a liquid; drawing air through the items in the container, desirably from top to bottom, to coalesce and remove liquid from the items in the container during a coalescing drying step; thereafter subjecting the container of items to a vacuum to produce dry items in the container during a vacuum drying step; and removing the container of items from the vacuum.

In accordance with another aspect, sufficient liquid is removed from the items in the container during a coalescing drying step so that the items in the container are substantially dried during a later vacuum drying step with the temperature of the items in the container upon completion of the vacuum drying step is desirably above freezing and more desirably above the dew point of the ambient environment where the vacuum drying step is being performed.

In accordance with a further aspect, a target time for the vacuum drying step is desirably determined that results in producing substantially dry items in the container upon completion of the vacuum drying step when drying a container of items in the container having the maximum amount of liquid of a plurality of containers of items to be processed sequentially or using the same processing steps. The duration of the coalescing drying step is selected such that sufficient liquid is removed from the items in the container during the coalescing drying step so that all of the plurality of containers of items processed during the vacuum drying step will be substantially dry upon completion of the vacuum drying step that does not exceed the target time. This target time can be very fast, such as from about two minutes to about six minutes. The target time can, for example, be established to be no longer than the longest of the preceding processing steps in a wet bath materials processing apparatus that subjects the items to be dried to plural processing steps prior to reaching the coalescing dryer.

In accordance with a still further aspect, liquid can be removed from the bottom of the container between the coalescing and vacuum drying steps. For example, the bottom of the container can be swept with a vacuum between these drying steps. As specific examples, a robot can move the container past a vacuum wand or a vacuum wand can be moved past the bottom of the container.

As a further aspect, the container of items can be heated such that the items are at a temperature of between 20° C. and 40° C. prior to or shortly after the commencement of the coalescing drying step.

As yet another aspect, air being drawn through the container can be drawn at a velocity corresponding to a mass airflow rate of about 1000 CFM to about 28000 CFM. In addition, the air being drawn through the container in the coalescing dryer can be at a temperature within the exemplary range of from 17 to 26 degrees Celsius.

In addition, during the vacuum drying step, the container of items to be dried can be subjected to a flash vacuum that results in a vacuum of less than five Torr during the vacuum drying step.

In accordance with an embodiment, an apparatus for drying containers of items comprises a coalescing dryer comprising a housing with an airflow inlet and an airflow outlet and defining an airflow passageway from the airflow inlet to the airflow outlet. The housing can comprise a container support adapted to support a container of items to be dried in the airflow passageway such that air flowing in the airflow passageway travels downwardly through the items to be dried in the container on a container support. The coalescing dryer can also comprise an air diverter operable to cause air in the airflow passageway to change its direction of flow following passage of the air through the items to be dried. The air diverter can comprise an airflow baffle positioned to cause air passing downwardly through a container of items to be dried to turn and pass upwardly to the airflow outlet. The terms upwardly and downwardly can, but do not typically, mean vertical air flow. An air mover can be coupled to the airflow outlet and operable to apply suction to the airflow outlet so as to draw air from the airflow inlet to the airflow outlet at a velocity that causes liquid in items to be dried to coalesce and travel downwardly from the items in the container and to pass from the container. In addition, a vacuum dryer for performing a vacuum drying step can comprise a vacuum chamber housing within which the container of items to be dried is positioned following drying by the coalescing dryer. The vacuum dryer can comprise a vacuum pump coupled to the vacuum chamber housing and operable to apply a vacuum to a container of items to be dried when placed in the vacuum chamber housing so as to evaporate liquid in the items to be dried that has not been removed by the coalescing dryer.

As a further aspect, the apparatus can comprise a robot operable to place a container of items to be dried on the container support of the coalescing dryer and to remove the container of items to be dried from the coalescing dryer. The robot can also be operable to place the container of items to be dried on a container support in the vacuum chamber housing and to remove the container of items from the vacuum chamber housing.

As yet another aspect, the apparatus can comprise a water remover that is operable to remove residual water from the bottom of the container prior to commencement of vacuum drying. One such water remover comprises a mechanism operable to apply a vacuum across the bottom of the container of items to be dried such as while the container of items to be dried is transported from a coalescing dryer to the vacuum dryer.

As a further aspect, the vacuum dryer can be operable to maintain the temperature of items in the container above freezing and more desirably above the dew point temperature of the ambient environment in which the vacuum chamber is being operated.

An apparatus comprising a coalescing pre-dryer and vacuum dryer can be part of a silicon material processing system that subjects plural silicon comprising material containing containers to a plurality of processes prior to the coalescing pre-dryer. One of such plural prior processes typically has a longest process time of the plural processes. The vacuum dryer is desirably operated to dry items in each container for a target time that is no greater than the longest process time of the plurality of processes. In addition, the coalescing dryer is desirably operated to remove sufficient liquid from the containers such that when each of the plural containers of items to be dried is subjected to vacuum drying in the vacuum dryer for no longer than the target time, the silicon comprising material in each of the containers is substantially dried in the vacuum chamber. The coalescing dryer can comprise a housing with a drain at a lower portion thereof that is selectively opened to drain the housing. The silicon processing system can be a wet bath processing system that places and removes a container of items to be dried in a liquid prior to delivery of the container of items to be dried to the coalescing dryer.

In accordance with a further aspect, the coalescing dryer can subject silicon material comprising items in a container to airflow in the range of from about 1000 CFM to about 28000 CFM and to flowing air having a temperature in a range of from about 17° C. to about 26° C.

These and other novel and non-obvious features and method acts will become more apparent from the description below and from the drawings. The invention encompasses all such novel and non-obvious method acts and features alone, as well as in combinations and sub-combinations with one another, as set forth in the claims below.

DETAILED DESCRIPTION

Figure 1:
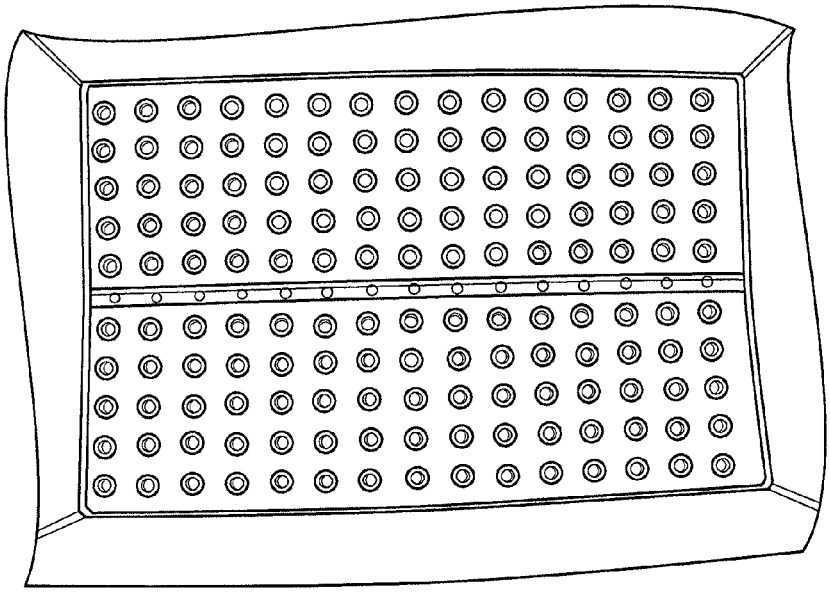
FIG. 1 illustrates a top view of a portion of a silicon carrier basket.

High purity polysilicon is the main raw material for the production of both silicon semiconductor devices and silicon photovoltaic solar cells. The polysilicon supply chain starts off with the production of metallurgical grade silicon (MGS) from high purity sand. MGS is then typically reacted with Hydrogen Chloride (HCl) to form trichlorosilane ($SiHCl_3$), which then goes through various purification stages to obtain pure $SiHCl_3$. The subsequent reaction of $SiHCl_3$ and Hydrogen ($H_2$) in a chemical vapor deposition reactor (CVD) will deposit high purity polysilicon onto heated monosilicon seed rods, which are later broken up into manageable-sized chunks for melting and casting into either poly-or-mono silicon. This is but one route to high purity polysilicon manufacture and is typified by the Siemens process. There are other routes as well, such as the fluidized bed reactor (FBR) process. Such processes are well-known to those versed in the arts, and their details will not be repeated here.

Two common grades of high purity polysilicon are the solar-cell grade silicon (SGS) and the electronic grade silicon (EGS). SGS is typified by a purity of 99.9999% Si, known as "six nines", while the purity of EGS is typified by a purity of nine to eleven nines (99.999999999%) Si.

Polysilicon may also be converted into monosilicon single crystal ingots prior to manufacture of semiconductor wafers or photovoltaic wafers. Again, these processes, including the Czochralski (CZ) method and the Float Zone (FZ) method are well known to those versed in the arts. In the process of becoming useful semiconductor or photovoltaic devices, polysilicon or monosilicon ingots are typically sliced into thin sheets known as wafers. The processes involved here are large, complex and again well known to those in the industry. However, as might be expected, in the course of all this melting, casting, grinding, slicing, growing and breaking, the need to purify and cleanse the silicon between steps is evident, in order to reach the high purity levels required. Further it is evident that considerable scrap and wastage would be produced if the cuttings and tailings from various slicing and breaking processes were not re-used in the product supply chain. In the course of handling, whether it be virgin CVD reactor-grown polysilicon, or re-claimed monosilicon tailings or scrap, considerable contamination, in the form of metallic, organic and inorganic impurities may be introduced. These impurities are typically removed by various methods involving chemical etches, washes and rinses. In cases where there is a wet process involved, there is a need to dry the silicon between stages such as before loading into a furnace in preparation for CZ or FZ growth of monosilicon, or casting into polysilicon ingots.

This drying is a critical path in the process. It is desirable that drying not introduce additional impurities, not grow or re-grow oxide or nitride layers, is energy efficient, results in complete drying without residual moisture, is cost-effective and is fast.

In the case of semiconductor devices, higher purity EGS enables the continuation of Moore's Law by allowing smaller and smaller device geometries. In the case of photovoltaic devices (solar cells), the driving factor in the acceptance of these devices as competitive with existing energy sources (hydro-electric, fossil fuels, nuclear fuels) is cost-per-watt. Great strides have been made in the last fifty years at improving the efficiency of solar cells and thus reducing the cost per watt, by increasing the watts produced per unit surface area exposed to solar radiation, but these efficiency gains are nearing an asymptotic limit. While efforts continue to be made, and will undoubtedly occur, to discover breakthrough technologies to significantly increase solar cell efficiencies above the current levels of 10-25%, the acceptance of solar power as a viable alternative energy source remains bounded by economic realities. As a result, the current trend is to focus on the reduction of manufacturing cost to achieve grid parity with conventional (electrical) energy sources. One of the ways to achieve cost-reduction in a manufacturing process is to scale up the process, and increase the process through-put rates of the sub-processes that make it up, while reducing their costs.

The method and apparatus disclosed herein addresses drying needs, for drying items to be dried, such as materials and objects with specific examples being granular and chunk material, electronic parts and often small objects. The method and apparatus is particularly useful for drying objects and materials that have unbound surface moisture that can be coalesced. Specific examples of materials that can be advantageously dried using these developments include semiconductor materials such as silicon (both reclaimed and raw silicon), particulate and chunk materials, usable in semiconductor circuit, solar panel and other applications. Embodiments of the disclosed process do not introduce additional impurities, do not permit or cause growth or re-growth oxide or nitride layers, are energy efficient, provide for thorough drying, and are cost-effective and fast.

The description below proceeds with reference to the example of drying reclaimed or virgin polysilicon material, but the invention is not limited to this particular material as it applies to both newly produced and reclaimed materials, including monosilicon, and to other items, such as electronic components and such as materials produced for use in or used in wafer production, or semiconductor processing and/or solar cell production applications.

In accordance with this disclosure, a liquid coalescence/vacuum dryer system and related methods are described for removing the liquid/moisture from these materials. In one specific example, a liquid coalescence vacuum dryer system comprises an integrated portion or module of a wet process system to remove liquids/moisture from polysilicon material.

The system in one embodiment comprises a series combination of a liquid coalescence pre-dryer followed by a flash vaporization vacuum chamber, the vacuum pumping system simultaneously removing the vapor produced. In a desirable embodiment, the material to be dried can be heated such as by rinsing in a heated bath of, for example, deionized (DI) water to raise the temperature of the material before delivery to the coalescence pre-dryer. The process is desirably controlled so that the material is not allowed to freeze during the vacuum drying portion of the process. If residual liquid is frozen, the drying process shifts to a sublimation process instead of a more rapid vaporization process.

Silicon material to be reclaimed comes in a variety of forms. For example, the silicon can be in the form of large chunks, boule tips and tails or slabs that are relatively easy to dry. As another example, the silicon to be reclaimed can be in the form of chips, rocks or gravel. In yet another form, the silicon can be provided in the form of fine chips, grains and dust, such as designated by the notation HSC-850.

Figure 2:
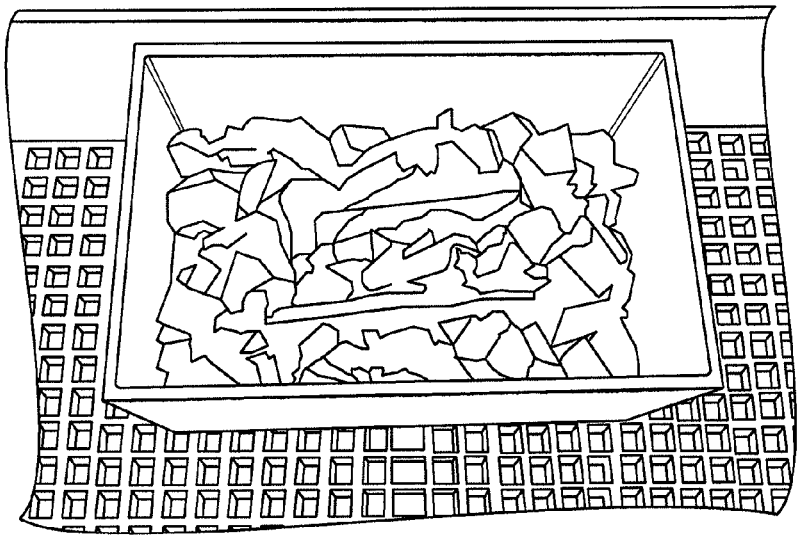
FIG. 2 illustrates a basket containing a mixture of silicon slab material and silicon chunk material.
Figure 3:
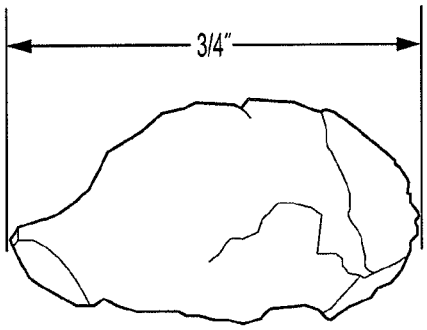
FIGS. 3, 4 and 5 illustrate respectively a piece of silicon gravel, a piece of silicon slab, and a silicon chunk.
Figure 4:
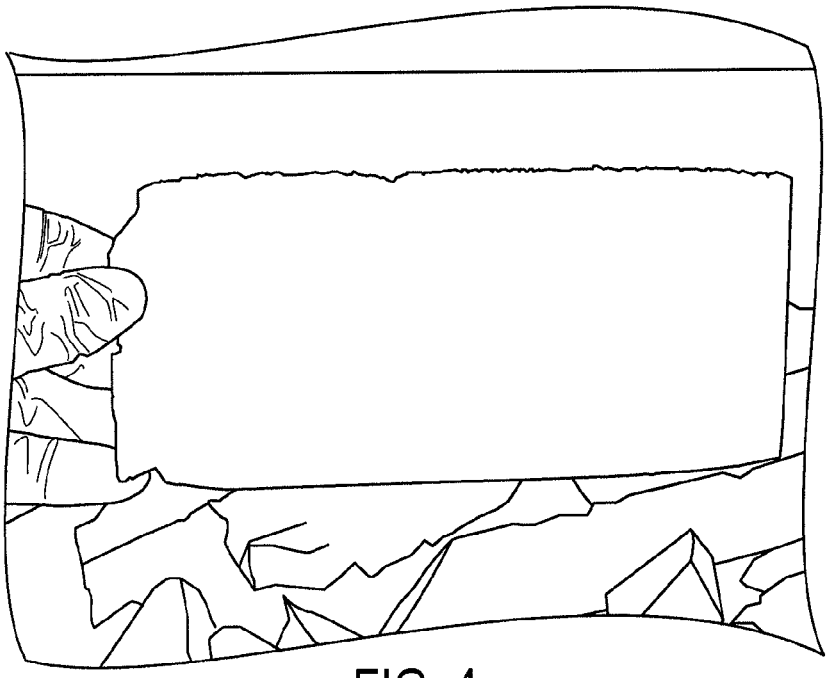
Figure 5:
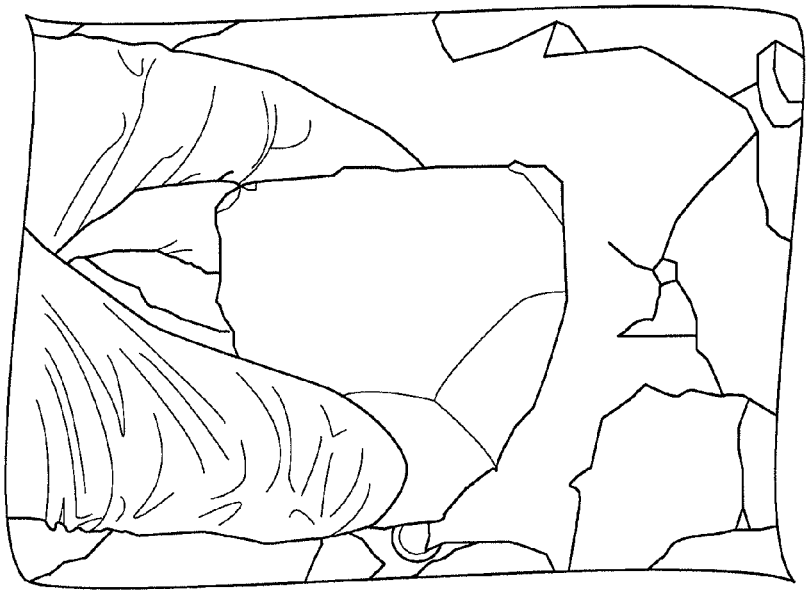

The pre-dryer unit is operable to coalesce a large amount of water trapped in interstitial spaces between pieces of silicon material, such as between the "rocks" that constitute silicon gravel. These spaces, in the case of gravel, can be on the order of magnitude of the size of an individual water droplet. Consequently, surface tension forces allow considerable water to accumulate in the gravel mass. The same holds true for smaller fine chip silicon, such as HSC-850. Typically 10 to 20 kilograms of material to be reclaimed is placed in a basket. Conventional silicon carrier baskets are made of a suitable material such as polypropylene with a perforated base comprising a plurality of small diameter openings therethrough. FIG. 1 illustrates a top view of a portion of one such basket. Plural openings can also be provided in the side walls of these baskets as well. FIG. 2 illustrates a basket containing a mixture of silicon slab material and silicon chunk material. FIGS. 3, 4 and 5 illustrate respectively a piece of silicon gravel, a piece of silicon slab, and a silicon chunk. Exemplary silicon gravel material averages about 1 cm by 1 cm by 2 cm in size; fine chips have a smaller average size; exemplary small rock averages about 5 cm by 5 cm by 3 cm; and exemplary large rock or chunks average about 5 cm by 5 cm by 7 cm.

In one desirable form, a pre-dryer functions by delivering airflow through the silicon mass from top to bottom and through the basket. Desirably, this is accomplished by suction from below. A relatively high velocity airflow is particularly effective. Air being delivered through the basket can be filtered, such as by passing it through a HEPA filter, prior to reaching the basket. The airflow causes migration of water droplets and the coalescence of small drops into larger ones, whereupon they are even more influenced by the downwardly flowing air and are sucked down and out from the basket. Typically only smaller droplets, having surface tension forces that are able to resist the airflow, remain. The baskets can be modified to reduce the pressure drop across the basket floor, resulting in higher velocity airflow, while in the pre-dryer to thereby increase the coalescence effect. In one experiment, the number of holes in a conventional basket was doubled, reducing the pressure drop across the basket from 2.5 inch water column (inch w.c.) to 1.0 inch w.c. Although variable, one exemplary blower having a maximum pressure of 11.5 inch w.c. was used. As is conventional, 1 inch w.c. is equal to about 0.0136 psi. The use of higher-suction pressure and higher airflow is desirable.

In the coalescing pre-dryer, it is not CFM or pressure drop across the bed per se, that is important, but rather airflow velocity through the wet material in the carrier basket. Every water droplet has a characteristic terminal velocity, whether free-falling in air or adhering to a surface. It is this critical velocity of water droplets adhering to a surface that must be exceeded in order to either displace the droplet, or break it up into smaller droplets. The critical velocity is a function of droplet size, viscosity and surface tension, with smaller droplets having a higher critical velocity than larger droplets. In plain terms, over a short time interval (short enough that evaporation does not play the major role in removing a water droplet), the local velocity of air past any given water droplet must exceed that droplets' critical velocity in order to displace it from the surface to which it adheres and allow it to be carried downstream in the direction of the airflow. Such displaced droplets may react in various ways depending upon local physical obstructions and local air velocity. Such droplets can remain relatively intact and be carried away by the airstream or they can 'run' across the surface to which they adhere. The droplets can break up into smaller droplets, and these smaller droplets can be carried away, only to adhere in a new location downstream where they may then remain relatively stationary if their new critical velocity is higher than that of the local airstream velocity. Droplets can also merge together, temporarily forming larger droplets which are then even more easily carried away by the airstream. The end result of this turbulent high velocity airflow is a final thin film of adhering water, and microscopic water droplets, both of whose critical velocity is too high to be removed by the prevailing local airstream.

In the case of a water droplet free-falling in air, the water drop initially starts out nearly spherical, as dictated by surface tension forces. As it accelerates, deformation by air molecules flattens the base and it becomes an oblate spheroid, which then develops into a concavity on the bottom of the drop. The concavity grows until the drop breaks up into a number of smaller droplets. The terminal velocity as a function of the equivalent diameter of the spherical drop is given by the polynomial equation:

$$V=1.02-0.015D-0.019D\hat{0}2+0.002D\hat{0}3$$

where:

V=terminal velocity in m/sec

D=drop diameter in mm

Typically, an upper limit exists in the condition of water drops, 6 mm in diameter and falling at speed of just under 10 meters per second in air.

The case of water droplets in contact with a bed of gravel is considerably more complex, turbulent and variable. The airstream general velocity is a function of blower horsepower, rated CFM and rated static pressure capability, and local velocity is a function of bed geometry, depth and particle size. For a given polysilicon material, the velocity of air through the bed is established sufficiently high so as to promote coalescence.

Figure 6:
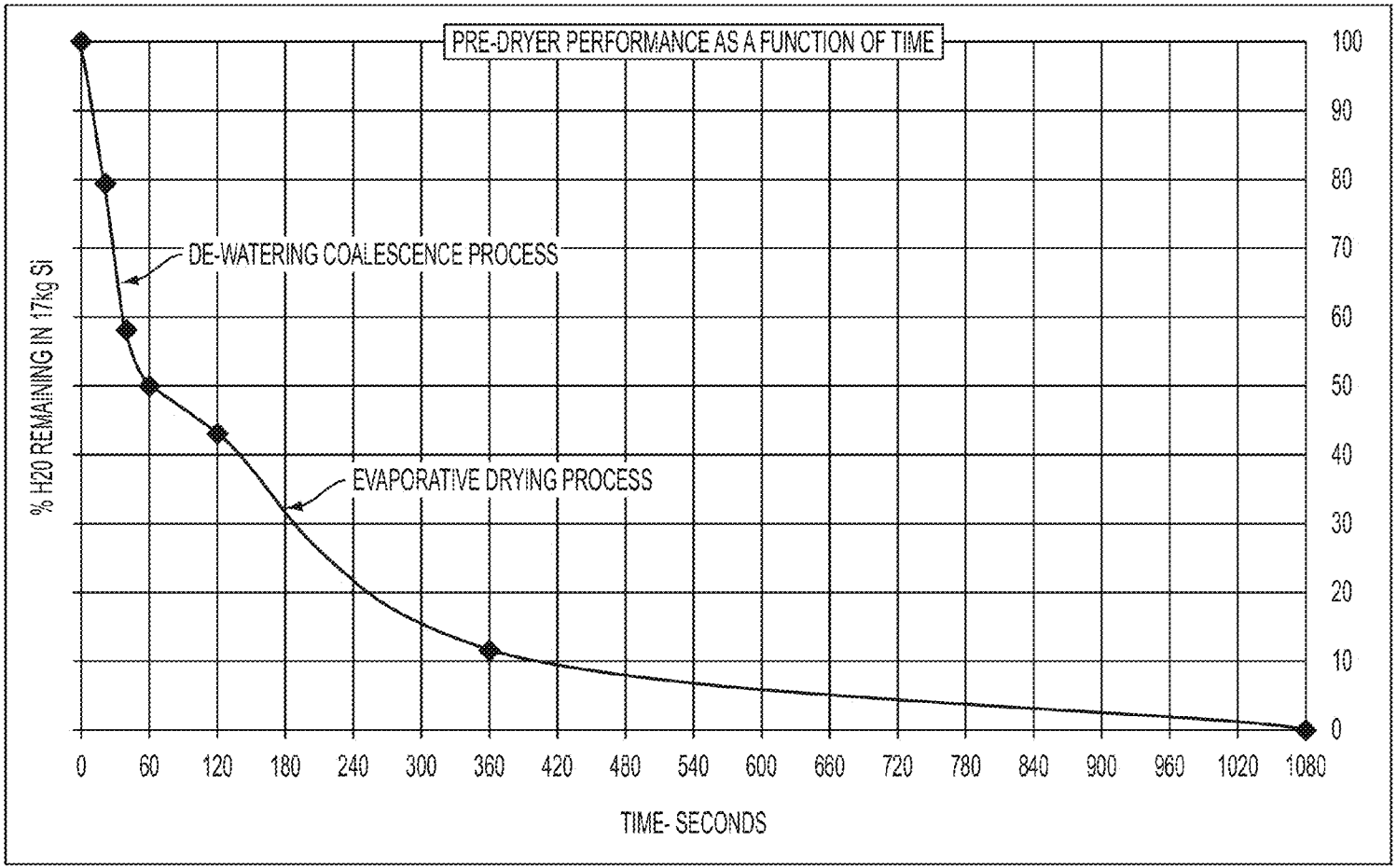
FIG. 6 is a graph illustrating the performance of an exemplary coalescing pre-dryer as a function of time for silicon gravel material.

FIG. 6 illustrates the performance of an exemplary coalescing pre-dryer as a function of time for silicon gravel material with airflow at 800 CFM and a suction pressure of 11.5 inches w.c. and with a conventional basket having a pressure drop of 2.5 inches w.c. across the basket. As one can see from this figure, the characteristic shape of the curve illustrates that two different physical processes are taking place. The initial steep slope shows the coalescing or de-watering process. This is especially pronounced for the first sixty seconds. The later, shallow slope (starting at about two minutes into the process) shows the evaporative process. Thus, even though evaporation occurs from the very beginning, it doesn't become the dominant water-removal process (in terms of grams of water removed per second) until about two to three minutes into the process. As can be seen from FIG. 6, the coalescing de-watering process removed about 50% of the water present during the initial sixty seconds of the pre-dryer cycle process and 90% of the water during the initial six minutes of the process. However, a significant amount of time was required to remove the remaining 10% of the water.

The evaporative process is slow and costly from an energy standpoint because of the high latent heat of evaporation of water. In contrast, the coalescing de-watering process is relatively fast and cheap, because it circumvents the latent heat energy requirements, as evidenced by the quantity of liquid water removed through the drain valve of the coalescence chamber after each process cycle. Therefore, by utilizing a pre-dryer that partially or substantially completes a de-watering coalescence process followed by a vacuum dryer cycle, drying time can be substantially reduced.

Desirably, following the coalescence process, the materials are subjected to a vacuum with parameters being selected such that the final temperature of the silicon material is above 1 degree centigrade to eliminate water freezing on the silicon. The vacuum pressure can be varied. If the water freezes, the water removal process changes from vaporization to sublimation, with sublimation being slower.

Desirably, the final silicon temperature is above the dew point temperature under ambient conditions of temperature and relative humidity so that atmospheric water vapor will not condense on the surface of the freshly dried silicon after completion of the process and re-exposure to atmospheric air.

In addition, by pre-heating the silicon prior to delivering the silicon to the pre-dryer section, drying time can be reduced. This pre-heating can be accomplished by, for example, rinsing the silicon in a last rinse that is at an elevated temperature such as 40° C. Desirably, the silicon is at a temperature of from about 20° C. to about 40° C. when delivered to the pre-dryer, with a lower temperature in this range (such as about 20° C.) being a desirable specific example.

The pre-drying and vacuum drying process times are each desirably targeted to be no longer than the time of the longest process in the polysilicon reclamation system. Therefore, with this approach, the total drying process step does not become a bottleneck in the system.

Although variable, vacuum levels are desirably set at 5 Torr or below. The process desirably proceeds as follows: As the pressure is reduced to the point of the vapor pressure of water at the temperature of the incoming material (at 20° C. this is approximately equal to 17.5 Torr), the water flashes to vapor and the latent heat of evaporation therein removes heat from the water, causing it to cool, and thereby cools polysilicon in contact with the water as well. As the polysilicon material is being cooled, the material transfers heat to the remaining water, allowing it to be vaporized at a somewhat lower pressure and temperature, and the process continues until sufficient heat is removed from the water and polysilicon material to allow the remaining water (if there is any) to freeze at a pressure of approximately 4.5 Torr. At this point, the process changes to one of sublimation rather than vaporization. Sublimation is considerably slower than vaporization and the process is desirably tailored to have all the water removed before reaching this condition (freezing). This process is also desirably tailored such that enough water is removed during the pre-dry stage that the final temperature of the dry polysilicon material is above the dew point at prevailing ambient conditions (outside the process chamber). This is done to prevent condensation of atmospheric water vapor upon the surface of the polysilicon material at the conclusion of the process.

I have discovered that a process model can be used to determine how much water, in terms of the ratio of mass of polysilicon being treated in a carrier basket to the mass of water going into the vacuum chamber, is required to be removed in order to produce dry polysilicon material in a target time, such as under 2 minutes, and at a final predetermined temperature, such as above freezing and more desirably above ambient dew point. For example, my new process model uses the known specific heat capacity of a material, such as silicon, and the known latent heat of vaporization of a fluid, such as water, and the measured fluid-carrying capacity of the material, and a known starting temperature, to predict the final temperature of the fully dried material. Thus, given the known water carrying capacity of various grades of polysilicon material, this model can be used to determine the quantity of water to be removed by the pre-dryer upstream of the vacuum chamber, such that the material can be successfully dried in the vacuum chamber in the desired time and be at or above a desired final temperature when completely dry. The quantity of water to be removed in the pre-dryer stage can also be empirically determined for given material to be dried. Flash drying in a vacuum chamber is, for all practical purposes, independent of material morphology and total material mass. Regardless of total water content, as long as the mass ratio of silicon to water is held below a critical minimum, then all of the water present can be evacuated in a vacuum flash dryer using only the sensible heat contained in the silicon to provide heat energy to overcome the latent heat of evaporation of the fluid, while achieving a desired final temperature at the point at which the water is exhausted. More particularly, in a process requiring exceptional levels of cleanliness, such as in the drying of silicon at purity levels of nine to eleven nines or greater, as required in the semiconductor or solar wafer industry, this allows drying to proceed without the use of heated airstreams which, if unfiltered, will contribute to contamination, and, even if filtered, can still contribute to oxidation. In contrast, a combination of drying using ambient HEPA (high efficiency particulate air) or ULPA (ultra low penetration air) filtered air followed by high vacuum minimizes any, and typically eliminates any, such contamination. A desired mass ratio of Silicon to water entering the vacuum chamber is 200:1 or greater to allow complete vaporization and removal of the water without lowering the temperature of the silicon below about one degree centigrade, and a preferred ratio is 400:1 or greater to allow the silicon to be completely dried and ending up at a temperature about eleven to fifteen degrees centigrade, which is above the dew point temperature typically found in semiconductor processing facilities. These ratios have been found to be independent of silicon morphology, and independent of total silicon mass. Thus, by controlling the mass fraction of silicon to water entering the vacuum chamber, complete drying in the vacuum chamber can be achieved while leaving the dried silicon at a desired temperature following drying.

An exemplary model and its application are as follows:

The maximum amount of water present in a basket of the polysilicon to be processed is determined, such as by estimation, weighing or other techniques. This maximum can be assumed to be the same for all baskets of polysilicon of the type being processed with the highest possible quantity of water of any basket of the plurality of baskets being processed being used as the maximum. This determined maximum can be increased by a tolerance factor, such as five percent, to maximize the probability of never underestimating the amount of water in any of the baskets. The amount of process time in the vacuum portion of the dryer (target time) is set, such as a two minute target time (or another target time that is desirably of a time that is less than or equal to the longest other process time in the material production or reclamation process so that drying does not become a bottleneck in the process). At a given low vacuum of the vacuum chamber, such as 5 Torr or less, a determination is made of how much water can be removed by the vacuum chamber while keeping the polysilicon at or above a desired minimum temperature, such as above freezing, or more desirably, and alternatively, above the dew point under ambient conditions where the drying process is being performed.

The pre-dryer (coalescing dryer) parameters (e.g. air flow rate [velocity], time in the pre-dryer, temperature of the entering polysilicon material, temperature of the pre-dryer air) can be established to remove enough water in the pre-dryer portion so that the vacuum dryer can remove the remaining water within the target time. The target time can also include the time required to load a basket into and unload a basket from the vacuum chamber with the pre-dryer removing enough liquid to allow complete drying of the polysilicon in the vacuum chamber target time including the vacuum chamber loading and unloading time. Thus, once a desirable target time is set for the vacuum dryer, and knowing the water content of a basket of material, the other process parameters can be set to result in a totally dry polysilicon exiting from the vacuum dryer portion of the dryer system.

It should be noted that the vacuum can be less than 5 Torr. For example, if the vacuum is reduced to 0.2 Torr, some ice may form on a basket, but the material (e.g., silicon) can be dumped from the basket free of the ice. The silicon has sufficient latent energy to retain the desired temperature. If the silicon is dry before the vacuum reaches a level where ice could form on the silicon (e.g., 4.5 Torr) the temperature of the silicon will remain above 0° C. even if the vacuum drops.

As a specific example, with reference to FIG. 6, a pre-dryer removes 50% of the water from the silicon gravel within the first sixty seconds. If the silicon were first rinsed in the final DI bath with a temperature of 40° C. and pre-dried in a coalescing dryer for sixty seconds, also at 40° C., the remaining water can be removed in about 240 seconds using a vacuum at, for example, 5 Torr. In comparison, if there is no pre-drying coalescence dryer used at all, silicon gravel could only be dried by a vacuum alone at 5 Torr (without freezing) if it were preheated to 74° C., which is an unacceptable approach.

By using a six minute pre-dry time in the coalescing dryer, silicon gravel can be dried at 20° C. with a vacuum of 11 Torr. In a simulation model using a mass of 266.0 grams of silicon gravel at 40° C., containing 1.0 grams of water, and subjected to a vacuum of 27 Torr, vaporization of all of the remaining water takes place with the final silicon temperature being 27.2° C.

Typically some tanks in the wet process system for reclaiming silicon contain chemicals for cleaning and etching reclaimed polysilicon material, such as chunks of such material carried in a carrier, such as a basket, by a person manually or by an automated or semi-automated robotic system. Within the wet process system some tanks can contain deionized (DI) water for rinsing the polysilicon material. The chemical containing tanks generally clean, etch or strip elements from polysilicon material carried by the baskets when the baskets or other material carriers are lowered into the chemical bath. The DI water rinse tanks are typically used to rinse off the chemical residue after the polysilicon material has been cleaned, etched or stripped.

One example of a wet treatment station 10 in which a basket can be manually, automatically or semi-automatically processed by a person or robot through chemical and rinse baths to be delivered to the coalescing pre-dryer/vacuum dryer system 40 is described below. In this embodiment, the dryer 40 can be integrated within the wet process station as shown in FIGS. 7-11. The FIGS. 7-11 station comprises a single or series of modules for use in performing a process sequence of various steps utilizing chemical and rinse tanks to process polysilicon materials, which will require a drying step before they can be considered completely processed.

Figure 7:
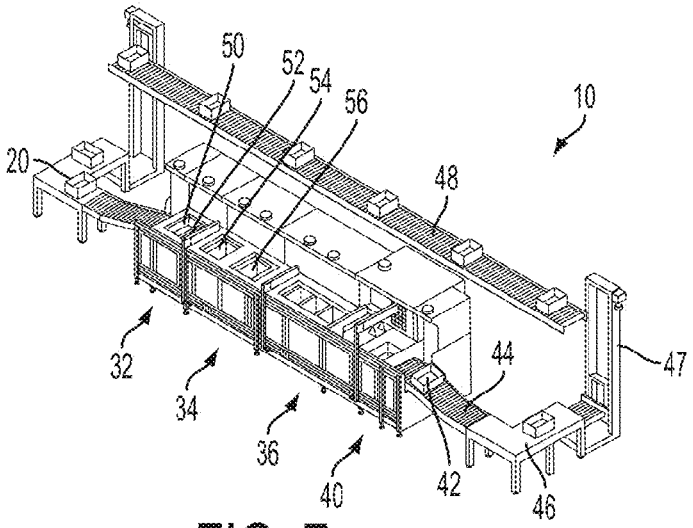
FIG. 7 illustrates a perspective view of one exemplary silicon reclaiming apparatus.
Figure 8:
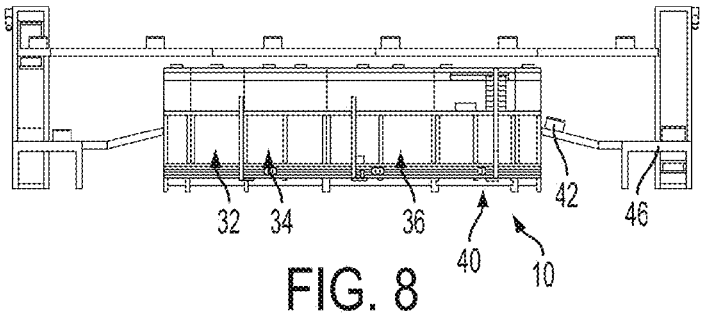
FIG. 8 illustrates a front elevational view of the apparatus of FIG. 7.
Figure 9:
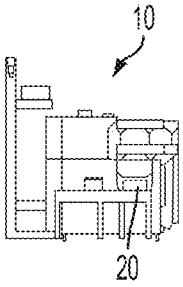
FIG. 9 illustrates an end view, looking from the left in FIG. 7, of the apparatus of FIG. 7.
Figure 10:
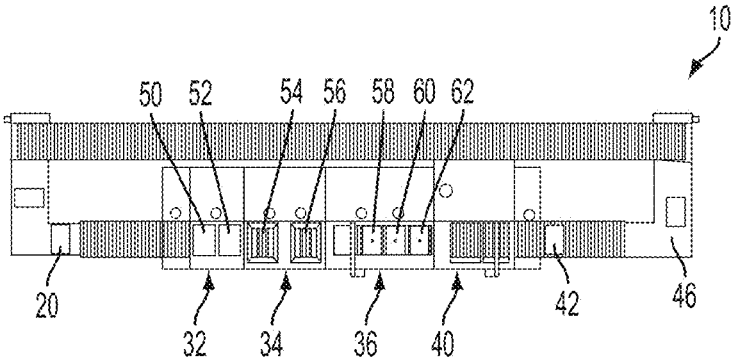
FIG. 10 illustrates a top view of the apparatus of FIG. 7.
Figure 11:
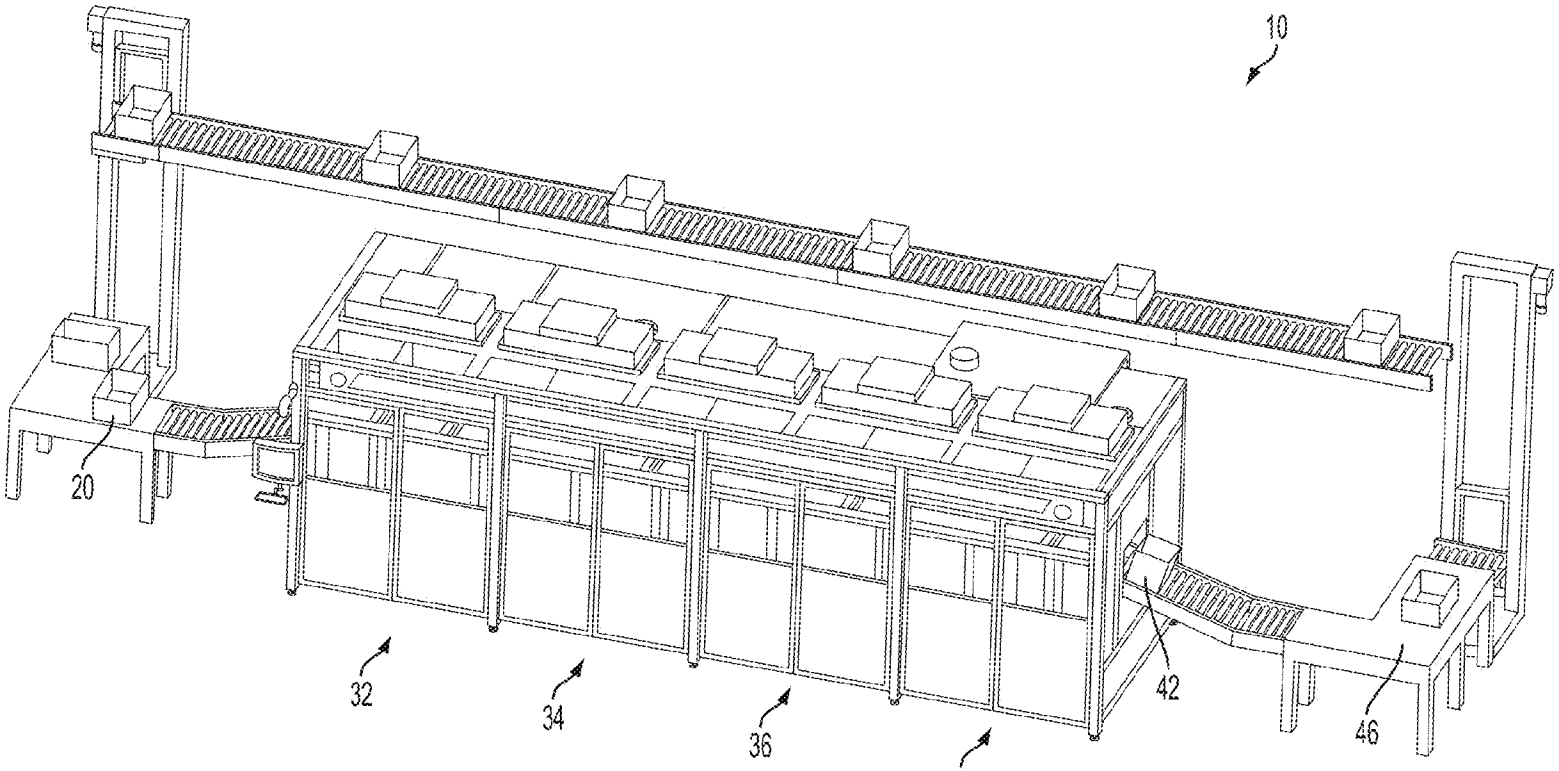
FIG. 11 is a perspective view of an embodiment of a silicon material reclaiming and/or processing system.

With reference to FIGS. 7-11, FIG. 7 illustrates a perspective view of one exemplary silicon reclaiming and/or processing apparatus, FIG. 8 illustrates a front elevational view of the apparatus of FIG. 7, FIG. 9 illustrates an end view looking from the left in FIG. 7 of the apparatus, and FIG. 10 illustrates a top view of the apparatus. FIG. 11 is a view similar to FIG. 7 with additional exemplary enclosing components illustrated therein.

With reference to these FIGS. 7-11, baskets of silicon material to be treated, such as basket 20, is delivered manually or via a conveyer to a first processing module 32 within the system. The material is conveyed, such as by robots from the first module 32 to a second module 34 and from module 34 to a third module 36. The material is also conveyed between respective tanks in modules that contain more than one treatment tank. In the illustrated embodiment, final drying processing is accomplished by a drying unit or drying system 40 comprising a coalescing pre-dryer and a vacuum dryer. Dried silicon in basket 42 is shown exiting via a conveyer 44 and/or rollers to an exit station 46. The processed silicon can be delivered, for example via an elevator 47, to a conveyor 48 to remove the silicon from the processing area.

The respective modules 32, 34 and 36 (or more or fewer modules as desired for the particular process being employed to reclaim the silicon), can contain one or more processing tanks for treating the silicon. For example, module 32 can comprise first and second tanks 50, 52 with tank 50 containing a heated surfactant and tank 52 being a rinse tank. Module 34 can comprise first and second etch tanks 54, 56, such as containing nitric acid. Module 36 can comprise a series of 3 (or more) rinse tanks 58, 60 and 62. One or more of these rinse tanks can utilize a heated final de-ionized water rinse which both rinses and warms the silicon prior to delivery to the dryer stage 40.

The dryer system 40, in accordance with this disclosure, comprises a de-watering coalescing dryer portion that partially dries the silicon material followed by a final drying of such material, desirably to a zero or substantially zero moisture content, by a vacuum dryer. The dryer system 40 need not be integrated into a wet processing station as it can be a standalone unit.

FIGS. 12-18 illustrate an exemplary form of dryer system 40 in accordance with this disclosure comprising a coalescing de-watering or pre-drying unit and vacuum dryer that can be, for example, included as a module in a silicon processing system or operated as a standalone unit. The description below proceeds as if the dryer system 40 is a standalone system. Baskets or other material carriers can be transported, for example, by a conveyor, by robots, or manually, to the de-watering portion of the dryer indicated at 100 in FIG. 12 with the vacuum portion of the dryer being indicated by number 110 in this figure.

Figure 12:
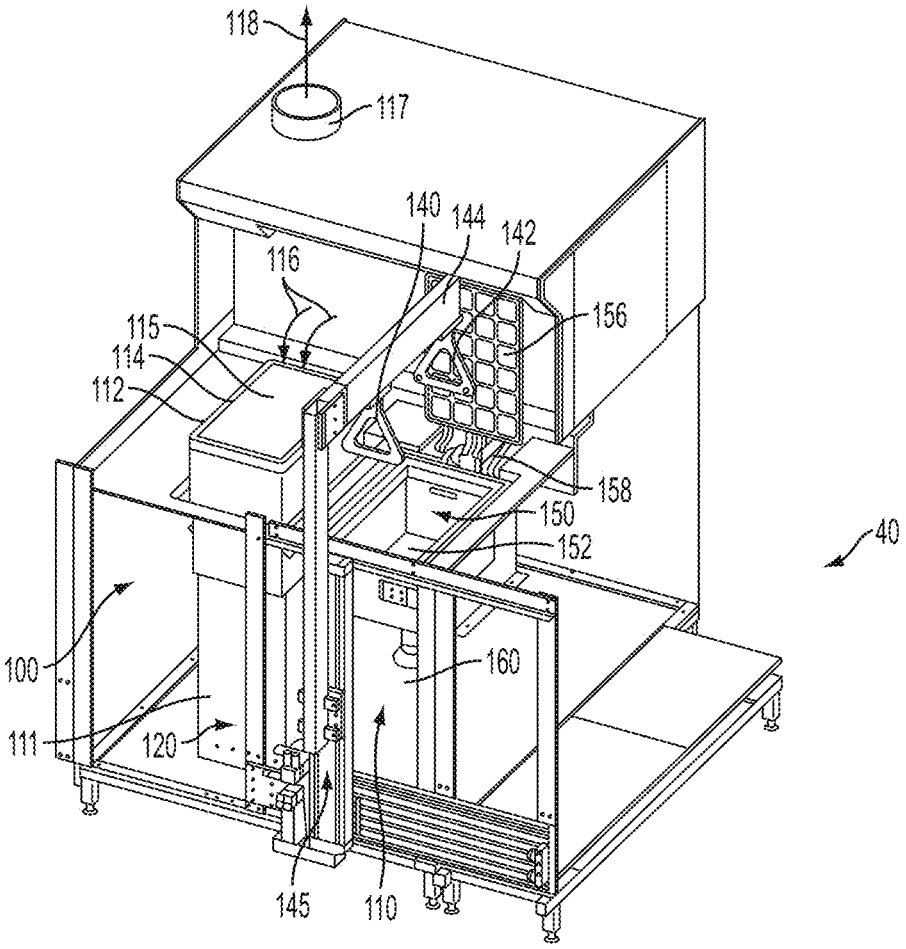
FIGS. 12 and 13 illustrate partially broken away perspective views of an embodiment of a dryer system in accordance with this disclosure.
Figure 13:
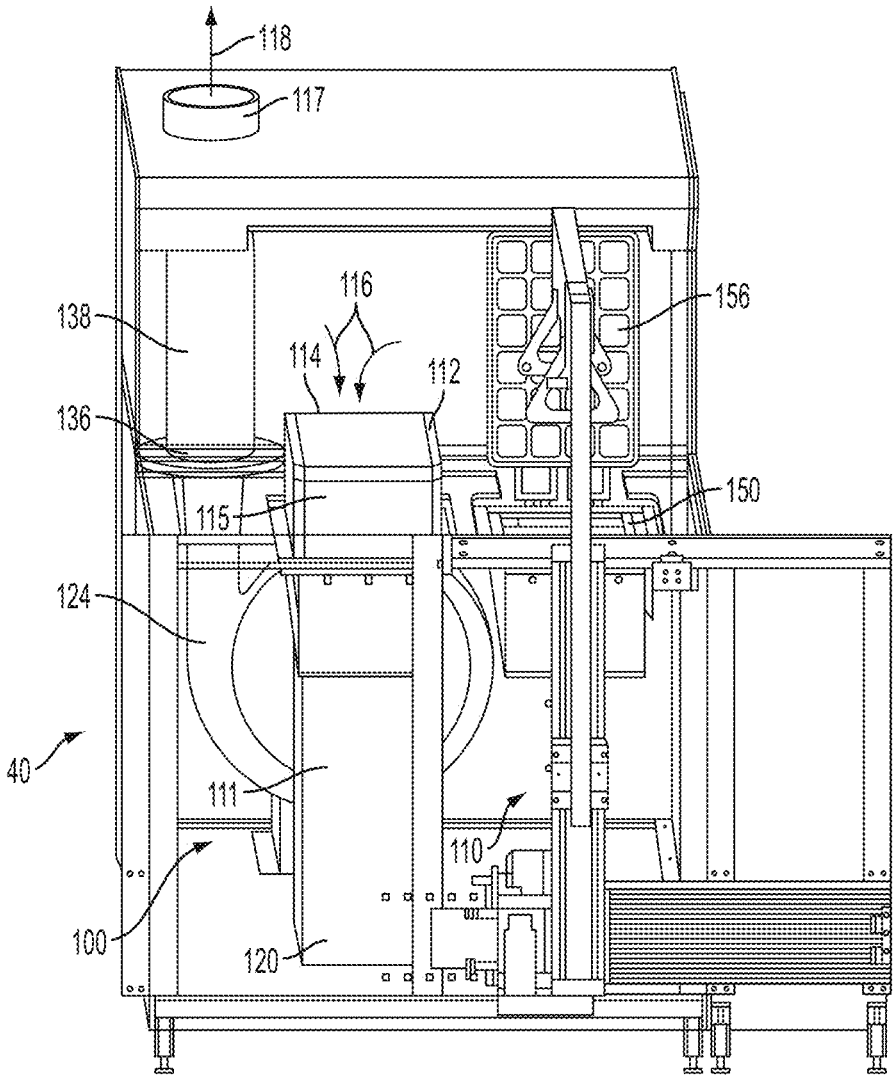
Figure 13A:
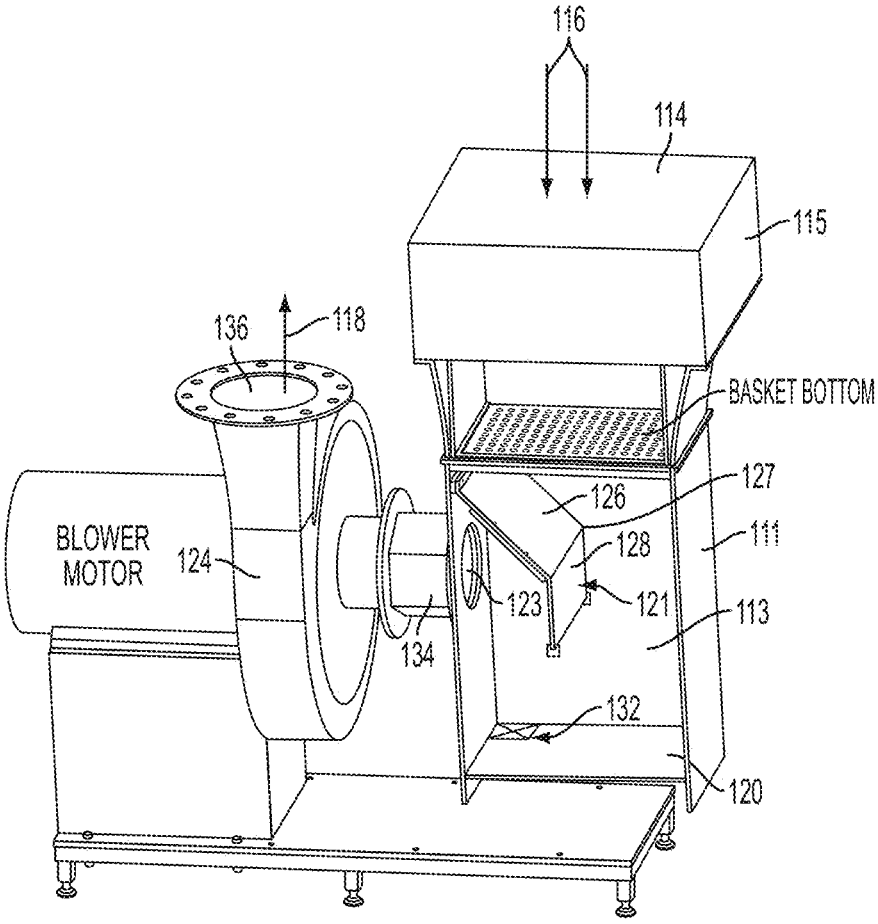
FIG. 13A is a partially broken away side elevational view of the dryer system of FIGS. 12 and 13.
Figure 13B:
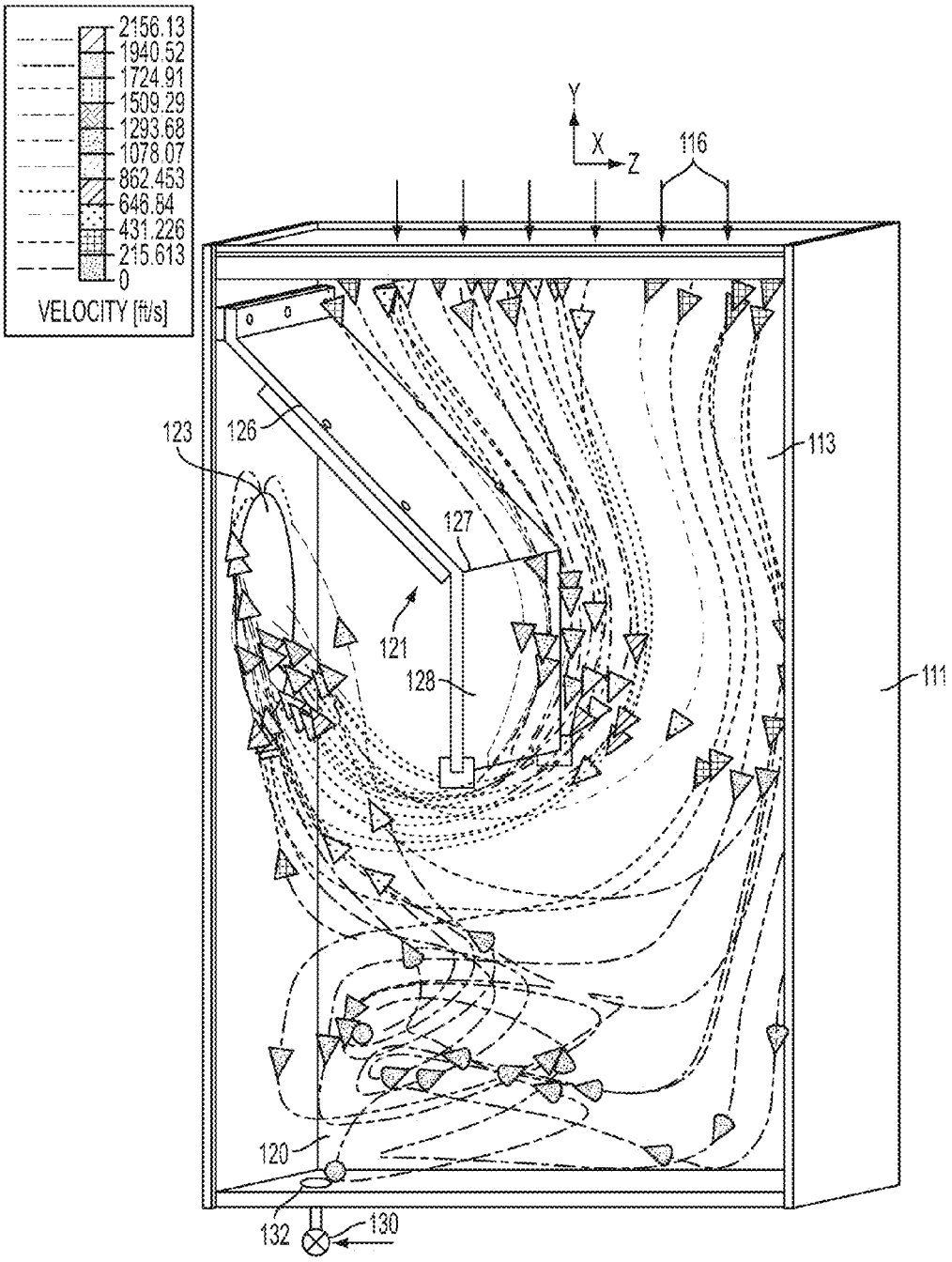
FIG. 13B is a schematic illustration of airflow through a plenum chamber portion of a dryer system of FIG. 13A.
Figure 13C:
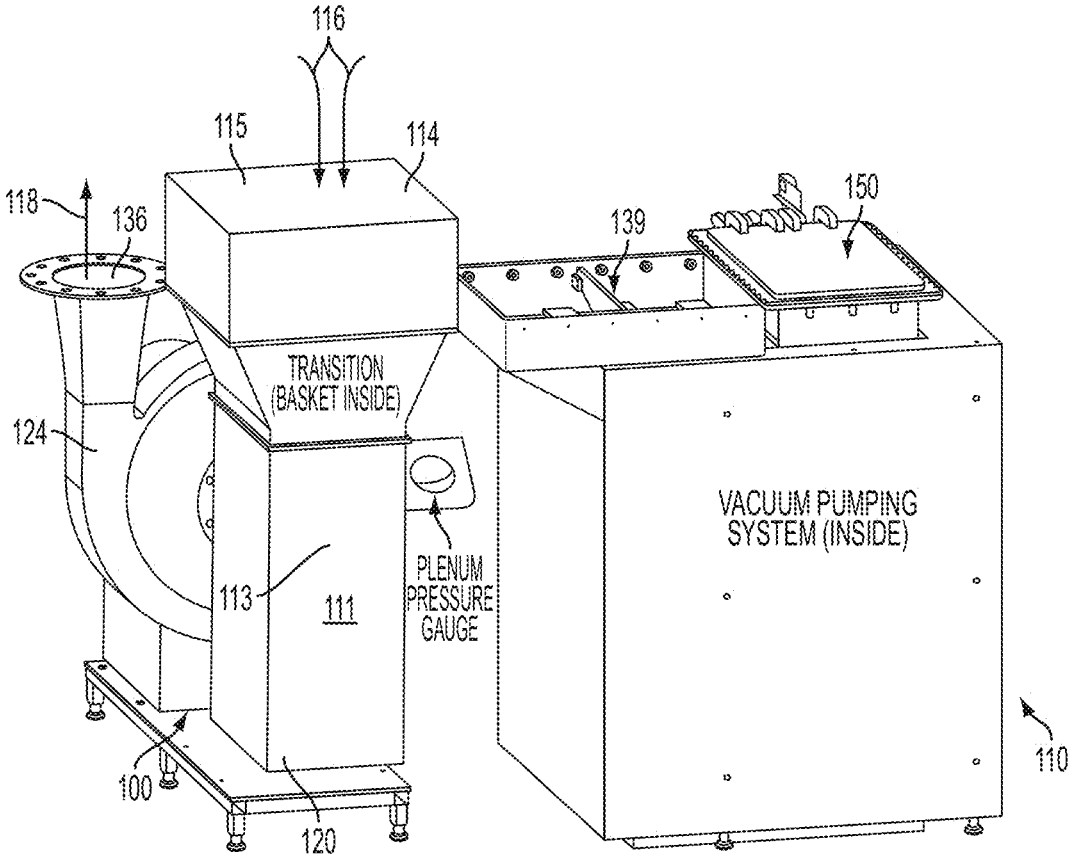
FIG. 13C is a partially broken away view of portions of the dryer system of FIG. 12 with a coalesced water droplet remover such as a vacuum wand.
Figure 14:
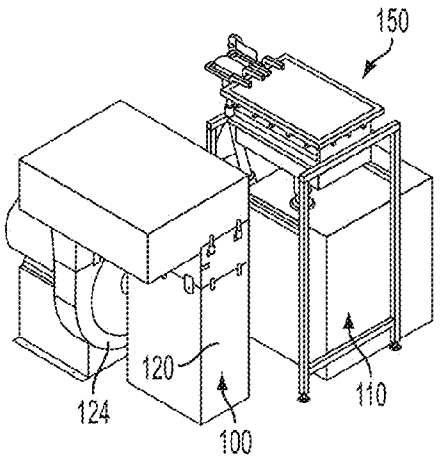
FIG. 14 is a perspective view of an alternative form of a dryer system.
Figure 15:
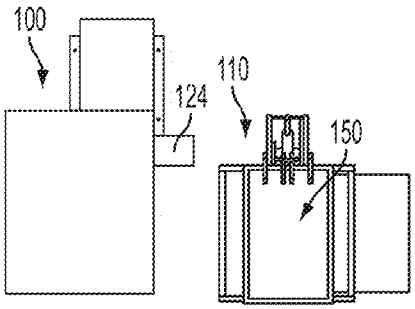
FIG. 15 is a top view of the embodiment of FIG. 14.
Figure 16:
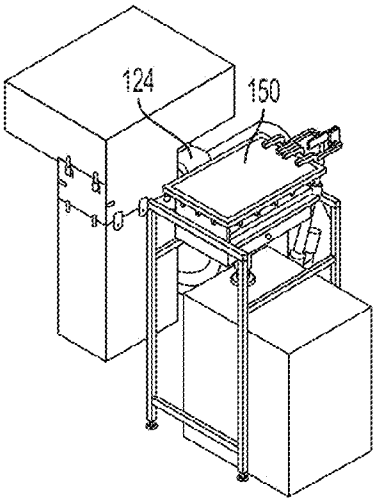
FIG. 16 is a perspective view of the embodiment of FIG. 14 looking downwardly toward the right front portion of the FIG. 14 dryer system.
Figure 17:
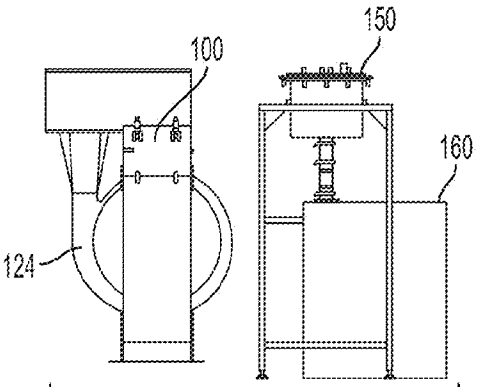
FIG. 17 is a front elevational view of the dryer portion of the dryer of FIG. 14.
Figure 18:
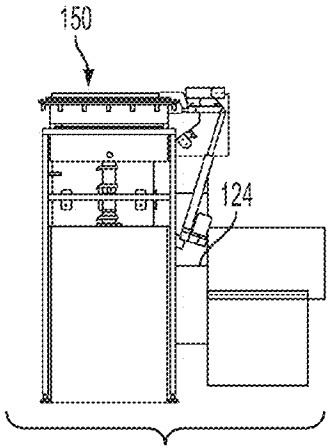
FIG. 18 is a side elevational view of the system of FIG. 14, looking from the right side of FIG. 14.

With reference to FIGS. 12, 13, 13A and 13B, the pre-dryer 100 can comprise a housing 111 comprising a plenum defining an internal air flow pathway. The housing can also include a lid 112, which can, for example, be hinged, for opening to allow insertion of the basket therein. The lid can comprise an air intake 114, which desirably includes a filter 115, such as a HEPA filter, for filtering air that subsequently passes through the silicon material containing basket positioned in the dryer portion 100. Airflow through lid 114 is indicated by arrows 116. Air flows downwardly through the basket in this example and through the plenum 113 of dryer portion 100 and then upwardly to an airflow outlet 117, with air being delivered from the outlet as indicated by the arrow 118. Within the plenum 113, air flows downwardly from the basket and is shielded, in this example, by a baffle 121 from passing directly to a plenum outlet 123. The illustrated baffle 121 comprises a downwardly angled first baffle portion 126 and a downwardly extending second baffle portion 128 that can be positioned in an upright or vertical orientation. Baffle portion 128 is coupled to a distal portion 127 of the first baffle portion 126. The baffle portions can extend or span from side to side of the plenum. The high velocity airflow is turned by the deflecting baffle 121 through an angle of approximately 180°, during which the higher density water and silicon (if any) are flung to the outside and downward, where they are assisted by gravity, and directed into the bottom of the chamber. The coalescing chamber bottom has a low air velocity region which prevents material that accumulates there from being stirred up again and re-entrained into the primary airflow. The associated flow model shown in FIG. 13A illustrates this velocity distribution. Between each drying cycle, or otherwise periodically or from time to time, for example in response to signals from a controller (not shown), a valve 130 (FIG. 13B) is momentarily opened to open a drain 132 located in the bottom of the plenum chamber 113 to allow the accumulated water to be drained off. Plenum chamber 113 thus comprises an exemplary form of a moisture separation/collection chamber. This draining action tends to carry away any silicon fines collected in the bottom of the chamber as well, and the chamber bottom stays relatively clean.

In the absence of a baffle or other water diverter or collector, a majority of this water may be sucked out through the exhaust line or opening 123 where it can thereafter potentially be deposited in an undesirable location; therefore it is desirable to collect this water. It is likewise desirable to collect and trap any silicon fines or chips, using a baffle or other collector, rather than sending them through the blower and exhaust duct where they may cause erosion, damage or collect in an undesirable and uncontrolled downstream location.

As an example of the function of this chamber and baffle, with a blower capable of producing 34 inches water column static pressure and a free air flow of 3500 CFM, and for a typical basket load of 15 kg of silicon gravel, which normally carries with it about 550 grams of adhered water, a cycle time in the coalescing chamber as short as ten seconds typically collects about 450 grams of water, and a cycle time of 120 seconds collects about 530 grams of water, or approximately 95% of the water present in the silicon. The remaining 5% of water can take a total cycle time of as long as six minutes to remove if only the pre-dryer were used to dry the polysilicon.

In operation, the internal baffle 121 separates both water and any silicon chips that fall through the basket holes from the main airstream. Thus the baffle 121 comprises one form of a water and particulate separator. The illustrated baffle 121 comprises upper and lower sections 126, 128. The lower section is shown to be vertical, but this is not required. In addition, the exemplary upper section is inclined upwardly from the upper edge 127 of section 121 toward an upper portion of a sidewall of plenum 111. Other forms of water and particulate separators can be used. A stand-alone particulate collector, such as a cyclone separator is an alternative form of particulate separator. Coalesced water droplets travel downwardly from the basket to a water collection area 120 from which the water can be removed. Gravity therefore assists in the de-watering as the coalesced droplets are both moved by air and gravity to the water collection area. As best seen in FIG. 13A, a blower, such as a centrifugal blower 124, applies suction below the basket for drawing air through the basket downwardly toward water collection area 120 with the air being delivered from the blower to the outlet 118. In this example, air exiting from plenum outlet 123 passes into a blower inlet 134, through the blower 124 and to a blower exhaust outlet 136. A conduit 138 (FIG. 13) couples the blower exhaust 136 to the air outlet 117, which can be an end portion of conduit 138.

Referring again to FIG. 12, following the partial drying of the silicon material by the coalescing dryer (it being understood that it is possible for the coalescing dryer to be operated partially into the evaporation region [see FIG. 6], although this is less desirable), the basket is removed from the coalescing dryer portion. Basket grippers 140, 142 coupled to a robot arm 144 can be moved in position over the basket in coalescing dryer 100 and lowered to a position for gripping the basket to lift the basket from the coalescing dryer and move it to a vacuum chamber 150 in vacuum drying portion 110 of the system 40. For purposes of illustration, in FIG. 12 an empty basket 152 is shown positioned within the vacuum chamber 150. A lid 156, having a perimeter vacuum seal is shown in FIGS. 12 and 13 in position to close the vacuum chamber. The lid can be supported by a suitable hinge, or otherwise, for lowering into position. In the illustrated embodiment, a conventional four-bar linkage 158 is used to allow parallel closing of the lid, meaning that surfaces of the vacuum chamber engaging seal of the lid are lowered toward the vacuum chamber in a horizontal plane. The vacuum pump 160 is then actuated to draw a vacuum in the vacuum chamber to accomplish final drying of the silicon material. Following drying, the silicon material basket is removed, such as by robot 145 and grippers 142, 140 for delivery from the dryer system 40.

In the case of a material processing system, each module can comprise its own robot for transporting a polysilicon material processing basket through the various treatment stations in the module and to the next module. Thus, the polysilicon processing basket or other carrier can be processed through the station with the material being cleaning, etched and with appropriate DI water rinse steps, such as between each chemical process tank. Again, the number and types of process tanks used in the system can be varied. Once the material is completely wet processed, the remaining liquid, such as the DI water, can be removed by the dryer system 40.

In accordance with this disclosure, a coalescing dryer/vacuum chamber drying system is employed to remove the liquid (e.g., DI water), leaving the material completely dry and cool to the touch at the end of a drying cycle. This cycle can be six minutes or much less.

In one specific example (herein after sometimes referred to as a Two Minute Cycle Process), 15.4 kg of silicon gravel can be completely dried in two minute cycle time in the vacuum dryer portion (with a two minute cycle time in the pre-dryer). In this example, a basket of silicon gravel with silicon at 20° C. was placed in the pre-dryer and subjected to a 1950 CFM airflow rate at 20° C. air temperature, with a pressure drop of 27 inches w.c. across the bottom of the basket for a period of two minutes. The basket was then placed in the vacuum chamber with the vacuum being dropped to 0.2 Torr. Upon cycle completion in the vacuum dryer, the material was completely dry, and at a temperature of 15° to 18° C. Since the two drying processes may occur simultaneously (the pre-dryer and vacuum dryer processes), on sequential baskets, the result (in an automated tool) would be a finished basket out at about every two minutes or a process throughput of about two minutes per basket. A superior drying system has been developed that, in one desirable embodiment, does not require (but does not preclude) heating the material above ambient temperature, that meets the industry standards for both cycle time and purity levels and that delivers dry material that is cool to the touch, but not so cold as to condense atmospheric moisture upon its' surface. An exemplary basic process sequence is for DI saturated polysilicon contained within a process basket or carrier to be inserted by an operator manually or by a robotic handler into the coalescing dryer section 100, as seen in FIG. 12. Once inserted into the first drying chamber, the lid 114 is closed and air flows downwardly through the basket of material. This partially dried material and basket is then transferred to the vacuum chamber or second drying stage. A short burst of gas such as CDA (clean dry air) or N2, blown across the sealing face prior to closing the vacuum chamber, can be used to maximize the integrity of the lip seal on the chamber. In an alternative embodiment, the lip seal knife jet blows outward and away from the center of the vacuum chamber, rather than inward toward the center of the vacuum chamber, to minimize the possibility of contamination being introduced over the silicon basket. Desirably after the lip seal clean cycle is complete, the chamber is sealed and the vacuum pump is engaged to accomplish the final drying. After the vacuum cycle is complete, vacuum can be broken using any means, such as re-exposure to atmospheric air, CDA, Dry N2, or any other fluid of composition, purity, temperature and humidity such as the downstream processes may require.

The processing parameters can be adjusted to fit the type of silicon material being processed. If mixtures of fine chips and/or gravel and coarser material are being processed, the processing parameters can be adjusted for parameters applicable to dry the finest (and most difficult to dry) material in the mixture.

In a silicon reclamation system or in a new material production system, electrical, pneumatic and facility supply hardware can be contained in various compartments within the station modules. The coalescing dryer and vacuum chamber, and the process cycle conditions are controlled to produce the drying effects.

As yet another example, a basket with 15 kg of silicon "gravel" typically carries 550 grams water with it when it is removed from the last DI rinse bath. When this basket, at 20° C., is placed on the coalescing dryer and the dryer operated for two minutes at a static pressure of 27 inches w.c. vacuum maintained below the plane of the basket bottom, approximately 530 grams of water is able to be drawn off the drain at the bottom of the coalescing chamber. This does not include water lost to evaporation.

At this point the silicon is still wet (below the top surface) with a thin film of water as well as numerous miniscule droplets of water. The basket also has a quantity of larger water droplets hanging from its very bottom surface. In order not to re-wet the silicon with these droplets after the vacuum finish-drying process (whether these droplets are frozen or liquid), it is desirable to remove these droplets in a suitable manner. For example, the basket can be slid or swept across a vacuum blade or vacuum wand 139, such as carried by a robot across the wand. The vacuum wand sucks the hanging droplets off the bottom of the container, generally in a single pass. Alternatively, the basket can be stationary, such as held by a robot in a stationary position, with the bottom of the basket swept by a vacuum wand, such as a pivoting wand, to remove water droplets at the bottom of the basket. However, the process can be performed without this droplet removal step. This basket is then placed into the vacuum chamber 150. The seal of the vacuum chamber is blown clean if desired, and the vacuum chamber lid is closed.

A vacuum valve to the pumping system is then opened, and a vacuum pump, such as a rated 204 ACFM and 0.01 Torr ultimate vacuum pump comprising, in one embodiment, a dry running screw pump in series with a mechanical booster pump, such systems being well-known to those versed in the high vacuum arts, is operated to pull a vacuum down to its ultimate Torr level for a period of two minutes (or an alternative target time). After two minutes, the vacuum level is generally less than 0.5 Torr. The vacuum chamber valve is then closed, the vacuum is broken and the chamber opened. When the silicon is removed, it is found to be completely dry, and generally at a temperature of 18° C. The water removed by the vacuum system is approximately 20 grams. Because the bulk of the water (530 grams) was removed with a mechanical process rather than a thermodynamic one (because little, if any, of the water was evaporated, as evidenced by the removal of these same 530 grams of liquid water through the drain valve of the coalescing chamber), a substantial energy saving is realized in the form of not having incurred the cost of overcoming the relatively large latent heat of evaporation of 530 grams of water. Also, such a process is extremely fast, because (a) mechanical dewatering is a very rapid process to remove a large quantity of water, but very slow to completely dry (remove the last traces of water) the silicon, and (b) vacuum flash evaporation is a very fast process to remove the final traces of water, but cannot handle large quantities of water without freezing the mass because of the limited amount of thermal energy contained in the silicon, and (c) both processes can be operated simultaneously on sequential baskets, therefore once the "process pipeline" is full, a basket can be processed in a target process time, such as every two minutes in a continuous automated operation. The embodiment described above is a cost effective, highly reliable, low "cost of ownership" system with relatively low maintenance complexity. The drying system has a relatively small footprint, and accordingly occupies a relatively small amount of expensive semiconductor or solar silicon plant floor space. The system also has a highly desirable cycle time that results in a superior high purity polysilicon material.

For purposes of this disclosure, the phrase "completely dry" means there is no weighable water using a 1000 gram capacity scale with 100 milligram resolution to conduct a "Loss-on-Drying" residual moisture analysis test. In accordance with this test, a basket with 15 kg of polysilicon gravel was dried using the Two Minute Cycle Process discussed above. At the end of the procedure, a representative sample of approximately 750 grams of silicon was selected at random from within the 15 kg of material in the basket and placed into a 1500 ml beaker. This sample and beaker was then weighed on a 1000 gram capacity scale with 100 milligram resolution. The beaker with the silicon sample was removed from the scale, heated to at least 150 degrees Centigrade, and then subjected to vacuum below 5 Torr while still hot, and then re-weighed. This process was repeated three times. The weight of the material and beaker was the same (within the 100 milligram sensitivity of the scale), meaning that there was no weighable water and the material was "completely dry". It is believed that there is far less water present in this sample than 100 milligrams, the lowest sensitivity of the scale, in this definition. This same procedure can be applied to other samples that are dried by any process to determine whether there is weighable water using a scale having this sensitivity, and if no weighable water is present, the material is "completely dry".

In addition, the term "substantially dry" in this disclosure means that, when a basket containing 15 kilograms of silicon material is dried and the material (without the basket) is immediately placed in a sealed, clean plastic bag, that no visible condensation forms within this bag. Material can be completely dry and still meet the definition of "substantially dry". However, material that is "substantially dry" is not necessarily "completely dry", as it is possible that some weighable water is present in an amount that is insufficient to cause condensation.

Also, the term "completely dry" does not mean that absolutely no water is present. That is, it is understood that any material exposed to the atmosphere can contain individual water molecules and monolayers of water molecules adhered to its surface. Such water molecules may only be detected by extremely sensitive tests, such as Karl Fischer titration, or they may even be below the threshold of such tests, yet there may still be some part-per-billion or less trace quantities of water molecules present, either in the form of sparsely adhered individual water molecules, or one or more monolayers of water molecules.

For independent verification of drying effectiveness, two 100 gram random lots were sent to an outside lab for testing. The first was a 100 gram control of known 'dry' silicon. The second was a 100 gram sample selected at random from a 15 kg lot processed by the pre-dryer and vacuum dryer portions of a dryer using the Two Minute Cycle Process procedure. The lab selected approximately a 50 gram aliquot from each sample submitted for testing and analyzed the material on a Sartorius MA-100 moisture analyzer. The moisture analysis of both samples came back as having a residual moisture content of less than 0.01%. At this level, the residual moisture, if any, was at a level below the threshold of detection of the Sartorius MA-100.

Furthermore, the term dry, for purposes of this disclosure, means no moisture on the material following drying that is visible to the naked eye.

The phrase "coupled to" in this disclosure includes both direct connection between elements that are "coupled to" one another and indirect connection by one or more intermediate elements. Also, terms such as "a" and "one", include the plural as well as the singular. Thus, if there is "a" or "one" element, unless otherwise expressly stated (such as by using a limiting term such as "only"), this is satisfied by the presence of two or more such elements because, when two or more such elements are present there is also "one" or "a" of such elements present. In addition, unless indicated by this description, method acts can be performed in other than a sequential order and with other method acts therebetween. Also, the terms "first" and "second" with respect to steps in a method do not preclude additional steps, including steps intermediate to the first and second steps. Also, a first or second step can respectively comprise a single step or can be broken into plural sub-steps.

Having illustrated and described the principles of my invention with respect to desirable embodiments, it should be apparent to those of ordinary skill in the art that this embodiment can be modified in arrangement and detail without departing from the inventive principles disclosed herein. We claim as our invention all such modifications.

I claim:

1. An apparatus for drying containers of items comprising:

a coalescing dryer comprising a housing with an airflow inlet and an airflow outlet and defining an airflow passageway from the airflow inlet to the airflow outlet, the housing comprising a container support adapted to support a container of said items to be dried in the airflow passageway such that air flowing in the airflow passageway travels downwardly through the items to be dried in the container when positioned on the container support, the coalescing dryer comprising an air diverter operable to cause air in the airflow passageway to change its direction of flow following passage of the air through the items to be dried;

an air mover coupled to the airflow outlet and operable to apply suction to the airflow outlet so as to draw air from the airflow inlet to the airflow outlet at a velocity that causes liquid in items to be dried in the container positioned on the container support to coalesce and travel downwardly from the items in the container and to pass from the container;

a vacuum dryer comprising a vacuum chamber housing within which the container of items to be dried is positioned following drying by the coalescing dryer, the vacuum dryer comprising a vacuum pump coupled to the vacuum chamber housing and operable to apply a vacuum to a container of items to be dried when placed in the vacuum chamber housing so as to evaporate liquid in the items to be dried that has not been removed by the coalescing dryer; and the apparatus included in a silicon comprising material processing system that subjects plural silicon comprising material containing containers to a plurality of processes prior to the coalescing dryer, one of such plural prior processes having a longest process time of the plural processes, wherein the vacuum dryer is operated to dry items in each container for a time that is no greater than the longest process time of the plurality of processes, and the coalescing dryer is operated to remove sufficient liquid from the containers such that when each of the plural containers of items to be dried is subjected to vacuum drying in the vacuum dryer for no longer than the time that is no greater than the longest process time of the plurality of processes, the silicon comprising material in each of the containers removed from the vacuum chamber following vacuum drying is substantially dry.

2. An apparatus according to claim 1 wherein the items to be dried comprise silicon and the coalescing dryer produces partially dried items having a mass ratio of silicon to water of two hundred to one or greater prior to positioning the container of items to be dried in the vacuum dryer.

3. An apparatus according to claim 1 further comprising a robot operable to place a container of items to be dried on the container support of the coalescing dryer and to remove the container of items to be dried from the coalescing dryer, the robot also being operable to place the container of items to be dried in the vacuum chamber housing and to remove the container of items from the vacuum chamber housing.

4. An apparatus according to claim 3 further comprising a water remover operable to apply a vacuum across the bottom of the container of items to be dried when the container of items to be dried is being moved by the robot from the coalescing dryer to the vacuum dryer.

5. An apparatus according to claim 3 wherein the vacuum dryer maintains the temperature of items in the container above freezing.

6. An apparatus according to claim 1 in which the vacuum dryer maintains the temperature of items in the container above the dew point temperature of the ambient environment in which the vacuum chamber is being operated.

7. An apparatus according to claim 1 in combination with a silicon processing system that places and removes a container of items to be dried in a liquid prior to delivery of the container of items to be dried to the coalescing dryer.

8. An apparatus according to claim 1 wherein the coalescing dryer subjects silicon material comprising items in a container to airflow in the range of from about 1000 CFM to about 28000 CFM without tumbling the items and to flowing air having a temperature in a range of from about 17° C. to about 26° C.

9. An apparatus according to claim 8 in which the air diverter comprises an airflow baffle positioned to cause air passing downwardly through a container of items to be dried to turn and pass upwardly to the airflow outlet.

10. An apparatus according to claim 1 wherein the housing of the coalescing dryer comprises a drain at a lower portion thereof that is selectively opened to drain the housing.

* * * * *